US005222775A

United States Patent [19]

Kato

[11] Patent Number: 5,222,775

[45] Date of Patent: Jun. 29, 1993

[54] POWER OPERATED LATCH DEVICE FOR AUTOMOTIVE BACK DOOR

[75] Inventor: Yuichi Kato, Yokohama, Japan

[73] Assignee: Ohi Seisakusho Co., Ltd., Yokohama, Japan

[21] Appl. No.: 857,994

[22] Filed: Mar. 26, 1992

[30] Foreign Application Priority Data

Mar. 29, 1991 [JP] Japan ..... 3-65939

[51] Int. Cl.[5] ..... E05C 3/26

[52] U.S. Cl. ..... 292/201; 292/216; 292/DIG. 43

[58] Field of Search ..... 292/201, 216, 280, 341.16, 292/DIG. 23, DIG. 43

[56] References Cited

U.S. PATENT DOCUMENTS

| | | | |
|---|---|---|---|
| 4,763,936 | 8/1988 | Rogakos et al. | 292/201 |
| 4,861,089 | 8/1989 | Compeau et al. | 292/201 X |
| 4,892,339 | 1/1990 | Kleefeldt et al. | 292/201 |
| 4,982,984 | 1/1991 | Yokota et al. | 292/201 |
| 5,007,261 | 4/1991 | Quantz | 292/201 |

FOREIGN PATENT DOCUMENTS 62-244988 10/1987 Japan .

*Primary Examiner*—Richard E. Moore
*Attorney, Agent, or Firm*—Foley & Lardner

[57] ABSTRACT

A power operated latch device for use in a hatch back type motor vehicle or the like. The device includes a striker secured to the hatch back door and a latch proper mounted to the vehicle body. The latch proper includes a base structure having a striker guide slot into which the striker is inserted when the door comes close to a door opening of the vehicle body, a pivotal structure connected to the base structure and pivotal between upper and lower positions, a latch plate carried by the pivotal structure and engageable with the striker, an electric motor securely connected to the base structure, the electric motor being arranged to lie parallel with respect to the base structure, a first mechanism for forcibly pivoting the pivotal structure between the upper and lower positions with the aid of the electric motor; and a second mechanism for forcibly driving the latch plate in a direction to disengage the striker from the latch plate with the aid of the electric motor.

15 Claims, 14 Drawing Sheets

POWER OPERATED LATCH DEVICE FOR AUTOMOTIVE BACK DOOR

BACKGROUND OF THE INVENTION

1. Field of the Invention

The present invention relates in general to latch devices for latching the automotive pivotal back door at its fully closed position with an aid of electric power, and more particularly to power operated latch devices of a type which comprises a power operated latch proper mounted to either one of the back door and vehicle body and a striker secured to the other, so that when the back door is pivoted down to its incompletely closed position wherein a latch plate of the latch proper is half-engaged with the striker, the latch plate is drawn into a full-latch position with the aid of the electric power thereby to cause the back door to take a fully closed latched position.

2. Description of the Prior Art

One of the conventional power operated latch devices of the above-mentioned type is disclosed in Japanese Patent First Provisional Publication No. 62-244988. The latch device disclosed in this publication comprises a power operated latch proper mounted to the vehicle body and a striker secured to the pivotal back door. The latch proper generally includes a latch plate, a vertically extending threaded bolt, a nut member operatively engaged with the threaded bolt and carrying the latch plate and an electric motor for driving the threaded bolt to rotate about its axis. When the back door is pivoted down to its incompletely closed position causing a half engagement of the striker with the latch plate, the electric motor starts to run and thus rotates the threaded bolt about the axis in a direction to move the nut member downward therealong. Therefore, the back door is brought into its fully closed latched position.

However, in some of the power operated latch devices of the above-mentioned type, compact construction or size-reduction has been given little thought. In fact, when the latch device is applied to back doors of a type which needs a larger force for obtaining an assured seal between the back door in the closed latched position and the vehicle body, a high powered and thus large-sized electric motor is necessary, which usually causes a bulky or large-sized construction of the latch device.

SUMMARY OF THE INVENTION

It is therefore an object of the present invention to provide a power operated latch device for automotive back doors, which exhibits a high power irrespective of compact size.

According to a first aspect of the present invention, there is provided a power operated latch device for use with mutually movable first and second structures. The latch device comprises a striker secured to the second structure; a latch proper mounted to the first structure, the latch proper including a base structure having a striker guide slot into which the striker is inserted when the first and second structures come close to each other; a pivotal structure connected to the base structure and pivotal between upper and lower positions; a latch plate carried by the pivotal structure and engageable with the striker; an electric motor securely connected to the base structure, the electric motor being arranged to lie parallel with respect to the base structure; first means for forcibly pivoting the pivotal structure between the upper and lower positions with the aid of the electric motor; and second means for disengaging the striker from the latch plate with the aid of the electric motor.

According to a second aspect of the present invention, there is provided a power operated latch device for use with mutually movable first and second structures. The latch device comprises a striker secured to the second structure; a latch proper mounted to the first structure, the latch proper including a base plate secured to the first structure and having a striker guide slot into which the striker is inserted when the first and second structures come close to each other; a motor supporting plate securely connected to the base plate in a manner to define therebetween a space, the motor supporting plate having an electric motor mounted thereto, the motor being arranged to lie with respect to the base plate in such a manner that an output shaft of the electric motor extends in a direction perpendicular to a direction in which the striker guide slot extends; a latch supporting plate installed in the space and pivotal between upper and lower positions, the latch supporting plate carrying a pivotal latch plate which is engageable with the striker; first means for forcibly pivoting the latch supporting plate between the upper and lower positions with the aid of the electric motor; and second means for forcibly driving the latch plate in a direction to disengage the striker from the latch plate with the aid of the electric motor.

BRIEF DESCRIPTION OF THE INVENTION

Other objects and advantages of the present invention will become apparent from the following description when taken in conjunction with the accompanying drawings, in which.

DETAILED DESCRIPTION OF THE INVENTION

Figure 2:
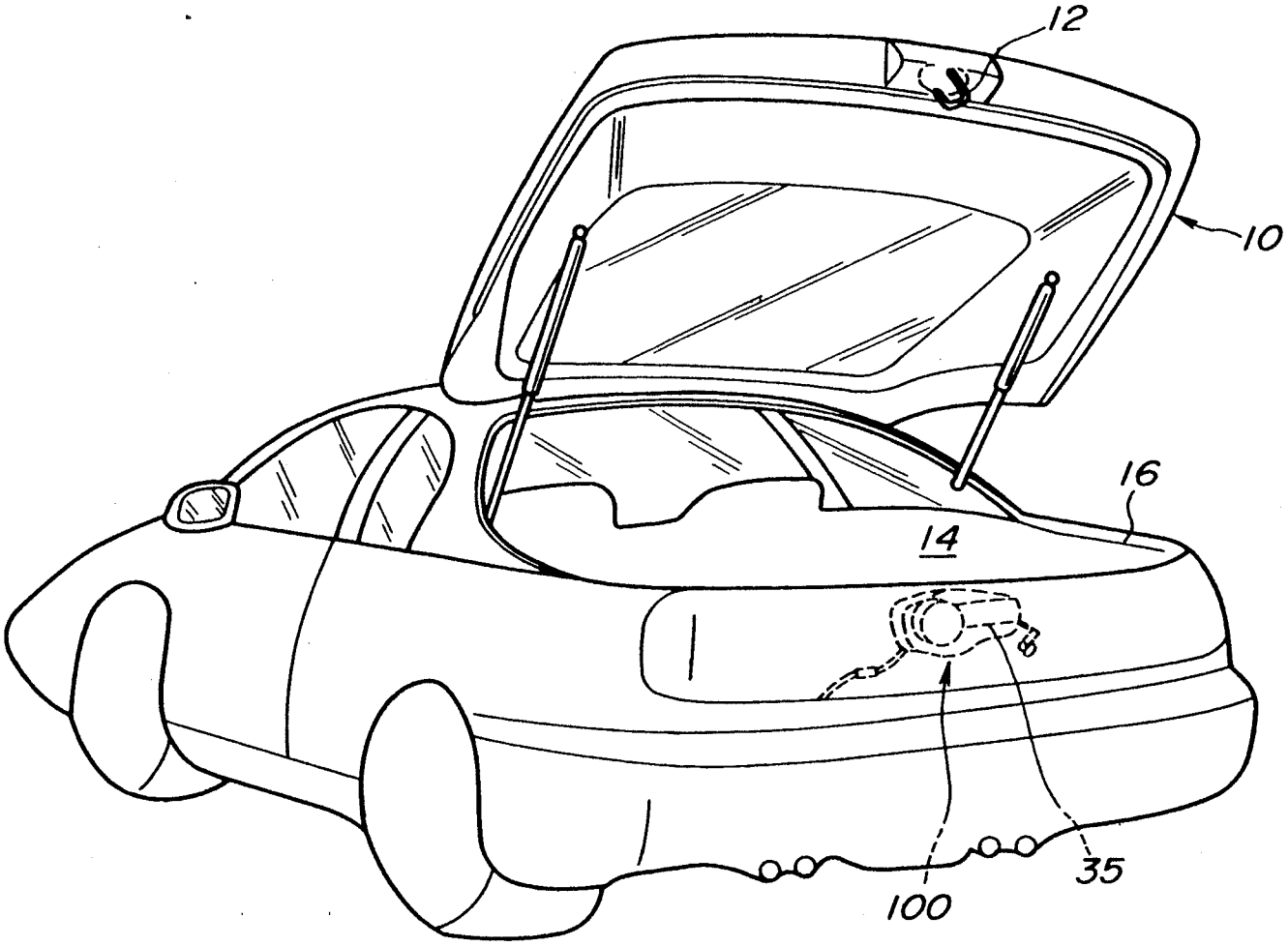
FIG. 2 is a back view of a hatch back type motor vehicle to which the latch device of the invention is practically applied.

Referring to FIG. 2 of the accompanying drawings, there is shown a hatch back type motor vehicle to which the power operated latch device of the present invention is practically applied.

The power operated latch device of the invention comprises generally a striker 12 which is secured to a free end of a pivotal (or hatch) back door 10 of the vehicle and a power operated latch proper 100 which is mounted to the vehicle body near a rear end of the back door opening 16.

As will become apparent as the description proceeds, when the back door 10 is manually pivoted down to its incompletely closed position causing a half engagement of the striker 12 with a latch plate of the latch proper 100, the latch plate is drawn to its lowermost position with the aid of electric power thereby causing the back door 10 to take its fully closed latched position.

Figure 1:
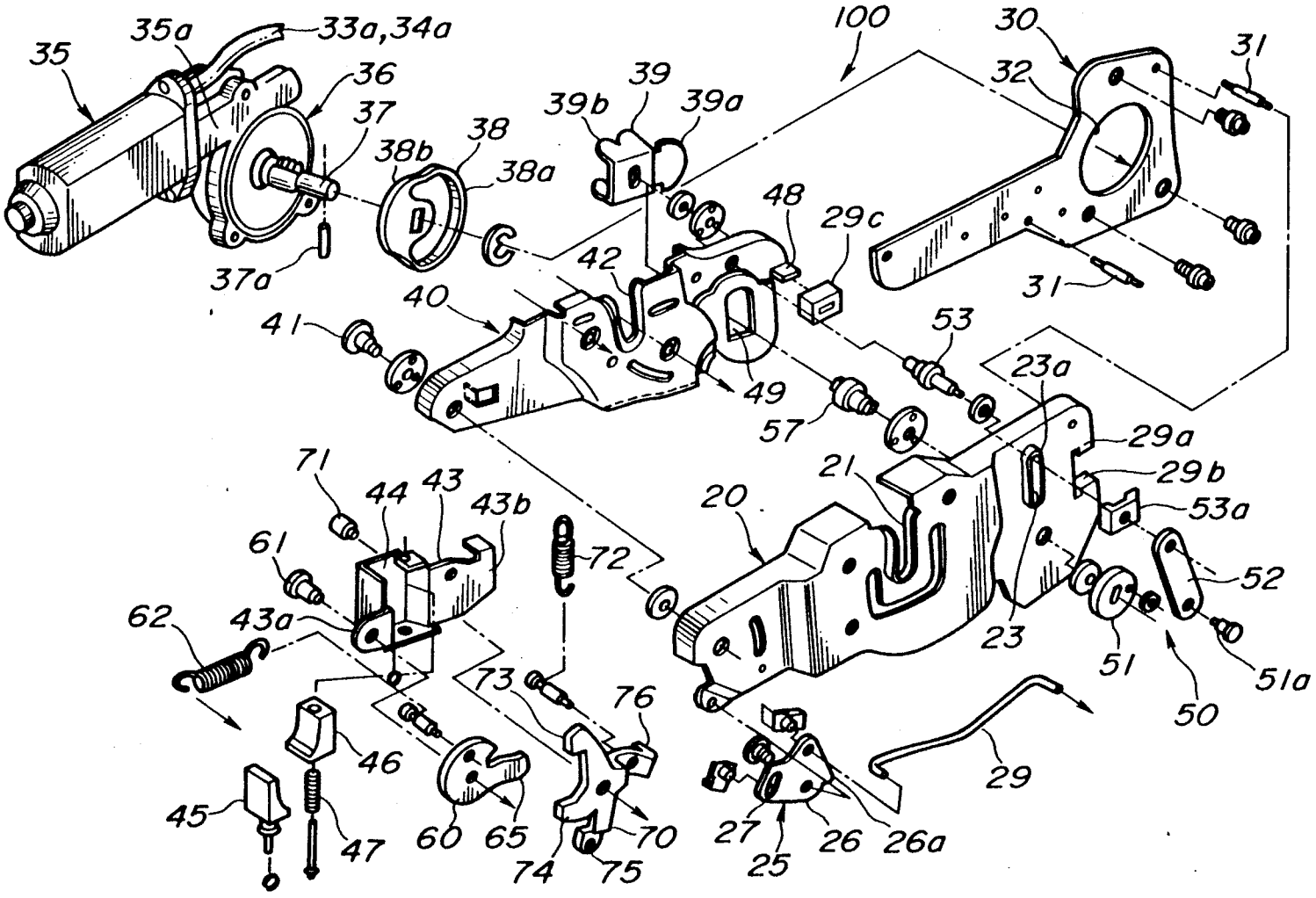
FIG. 1 is an exploded view of a power operated latch device according to the present invention.
Figure 3:
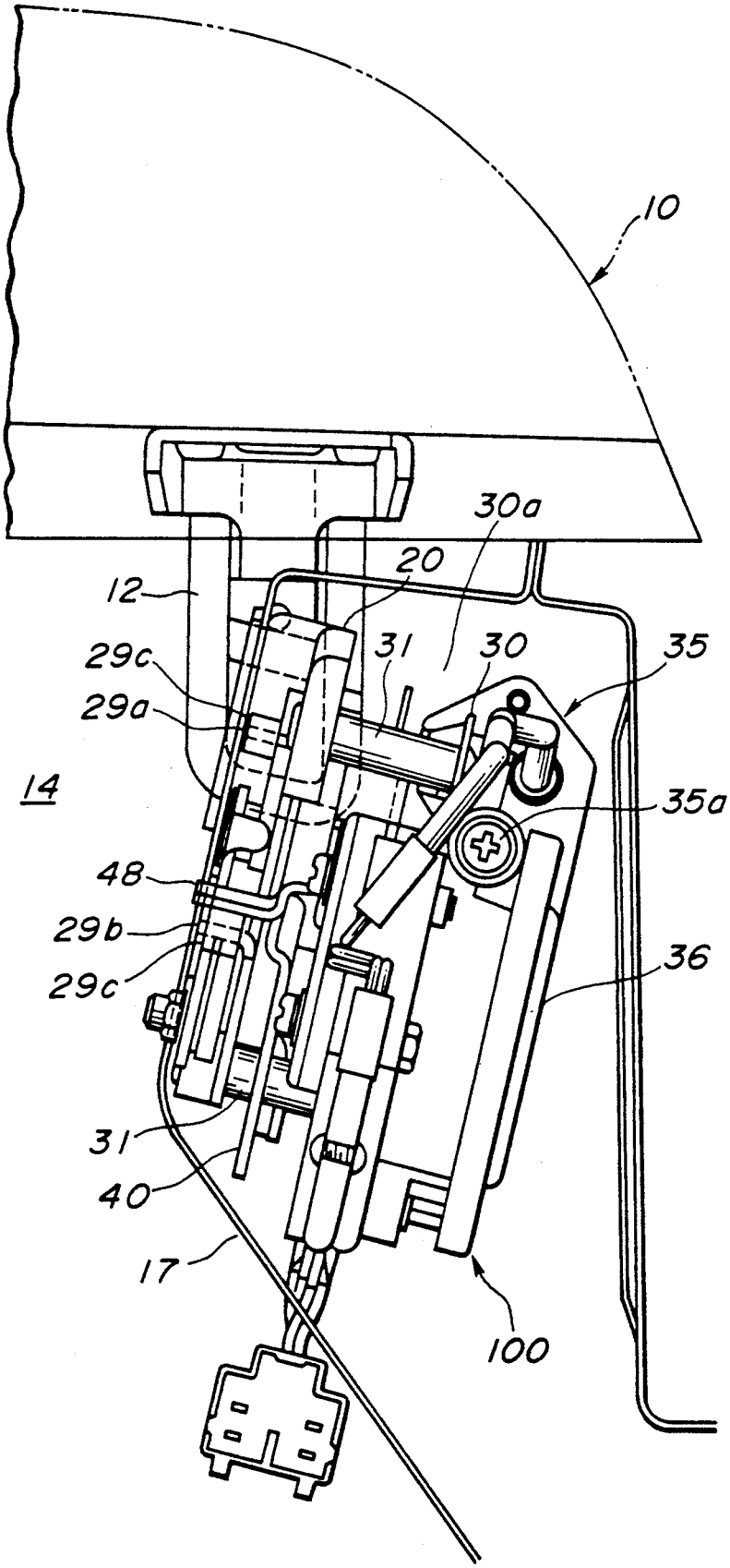
FIG. 3 is a side view of the latch device of the invention, showing a condition wherein a striker secured to a back door is fully latched by a latch proper mounted to a vehicle body.

As will be seen from FIG. 1, the latch proper 100 comprises a base plate 20 which is secured to an inner panel 17 (see FIG. 3) of the vehicle body near the rear end of the back door opening 16 (see FIG. 2), a motor supporting plate 30 which is arranged to lie over the base plate 20 and a latch supporting plate 40 which is installed in a parts-containing space 30*a* (see FIG. 3) defined between the base plate 20 and the motor supporting plate 30.

Figure 6:
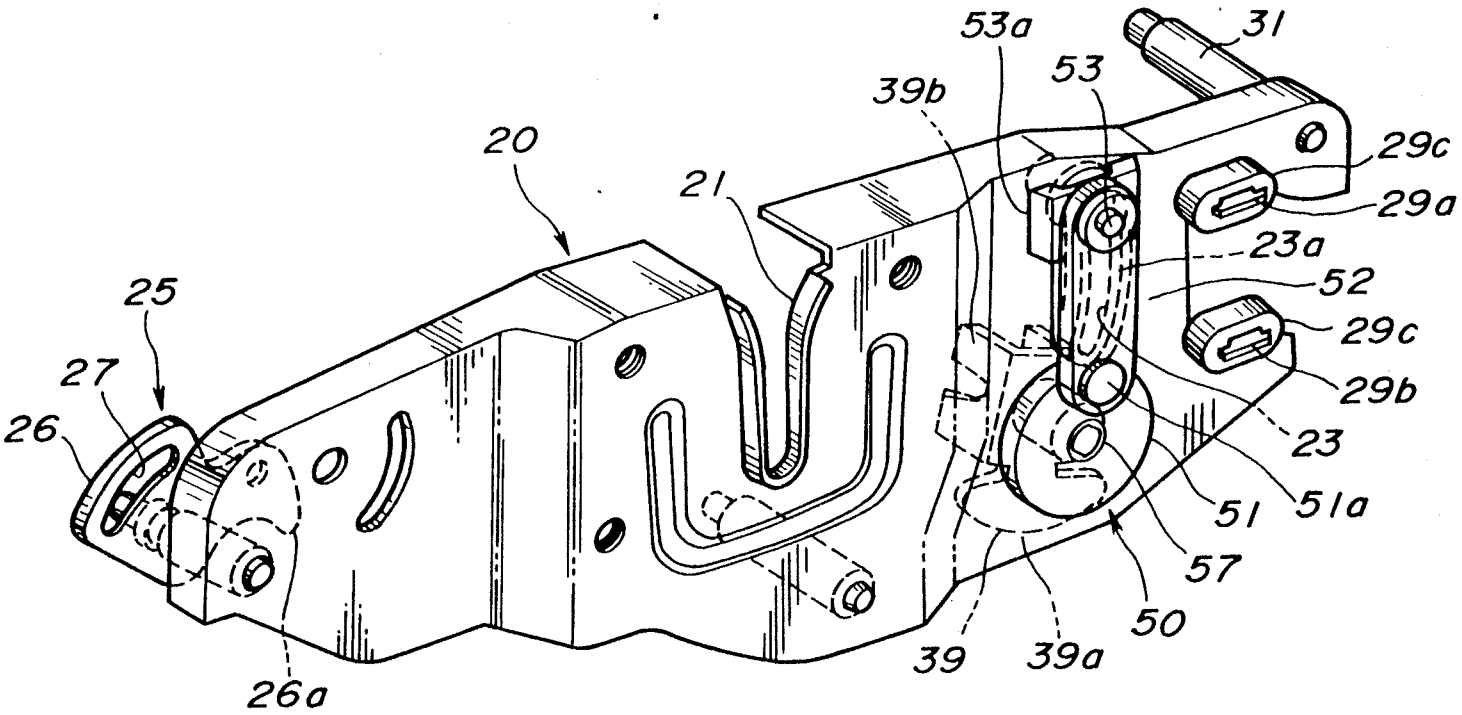
FIG. 6 is a perspective view of a base plate employed in the latch device of the invention.

As is best seen from FIGS. 1 and 6, the base plate 20 has at its laterally middle portion a striker guide slot 21 which extends vertically downward from an upper end of the base plate 20. The base plate 20 is equipped at one side portion with a locking-unlocking mechanism 25 which is actuated by a key cylinder mounted in the rear part of the vehicle body. The base plate 20 is further equipped at the other side portion with a pull mechanism 50 which is incorporated with a latch plate (60) mounted to the latch supporting plate 40.

As is seen from FIG. 1, the locking-unlocking mechanism 25 comprises a bell-crank member 26 pivotally connected to the base plate 20. The bell-crank member 26 has at its one end an elongate slot 27 with which an end of a connecting rod 27*a* (see FIG. 9) is slidably engaged.

Figure 9:
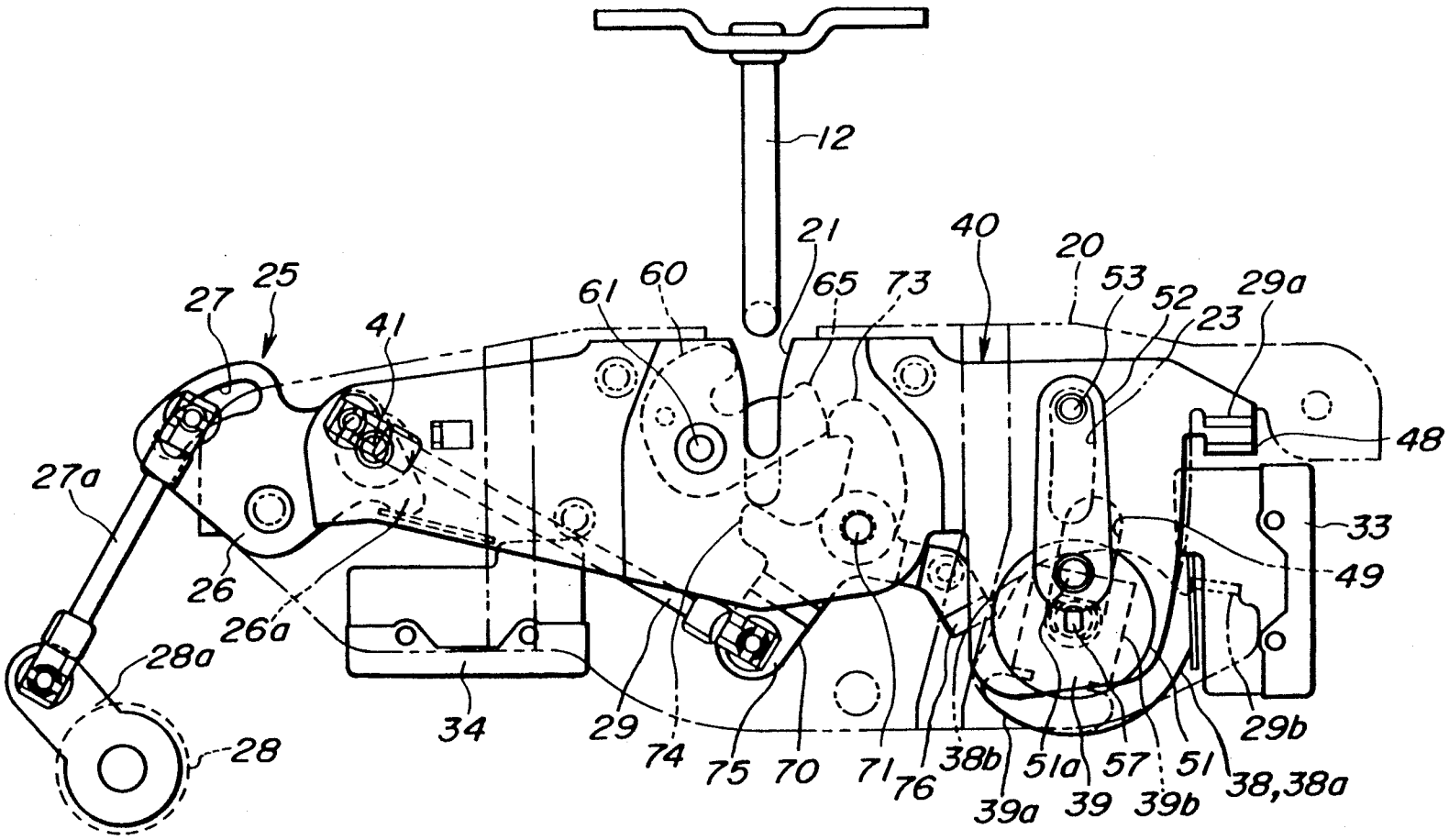
FIGS. 9 to 14 are front views of the latch device of the invention, showing various conditions which the device assumes.

As is seen from FIG. 9, the other end of the connecting rod 27*a* is pivotally connected to a link member 28*a* of a key cylinder 28 operatively mounted in the vehicle body. Thus, when the key cylinder is manually rotated in a given direction by a key from outside of the vehicle body, the link member 28*a* is rotated in the same direction to actuate the bell-crank member 26.

Figure 4:
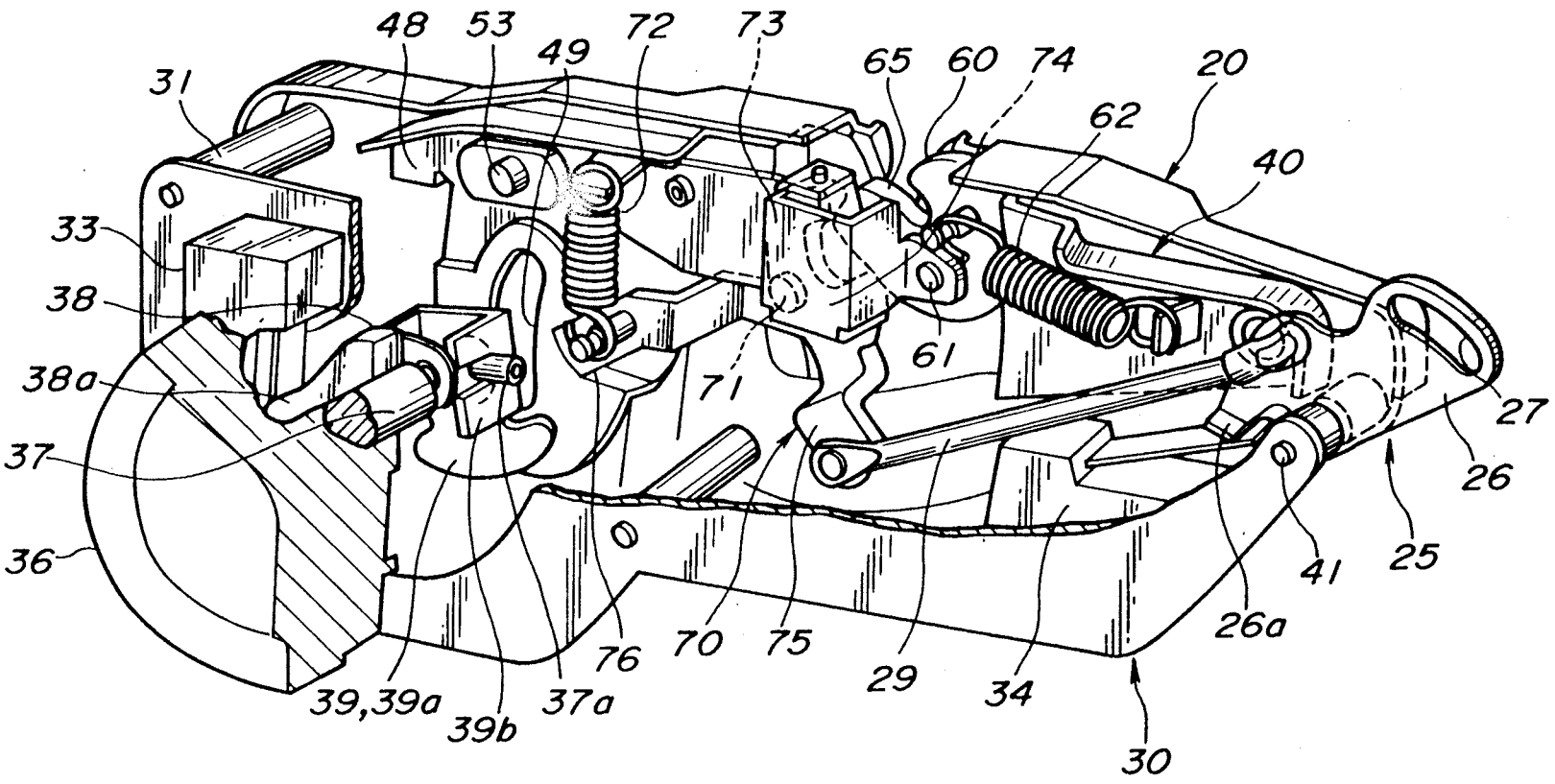
FIG. 4 is a perspective back view of the latch device of the invention with some portions removed.

As is seen from FIGS. 1 and 4, the bell-crank member 26 has the other end pivotally connected to an end of a connecting rod 29 which extends toward a middle part of the base plate 20. As is best seen from FIG. 4, the bell-crank member 26 has near the other end thereof an inward projection 26*a* whose movement can be detected by a limit switch 34 which is mounted to the motor supporting plate 30.

Figure 5:
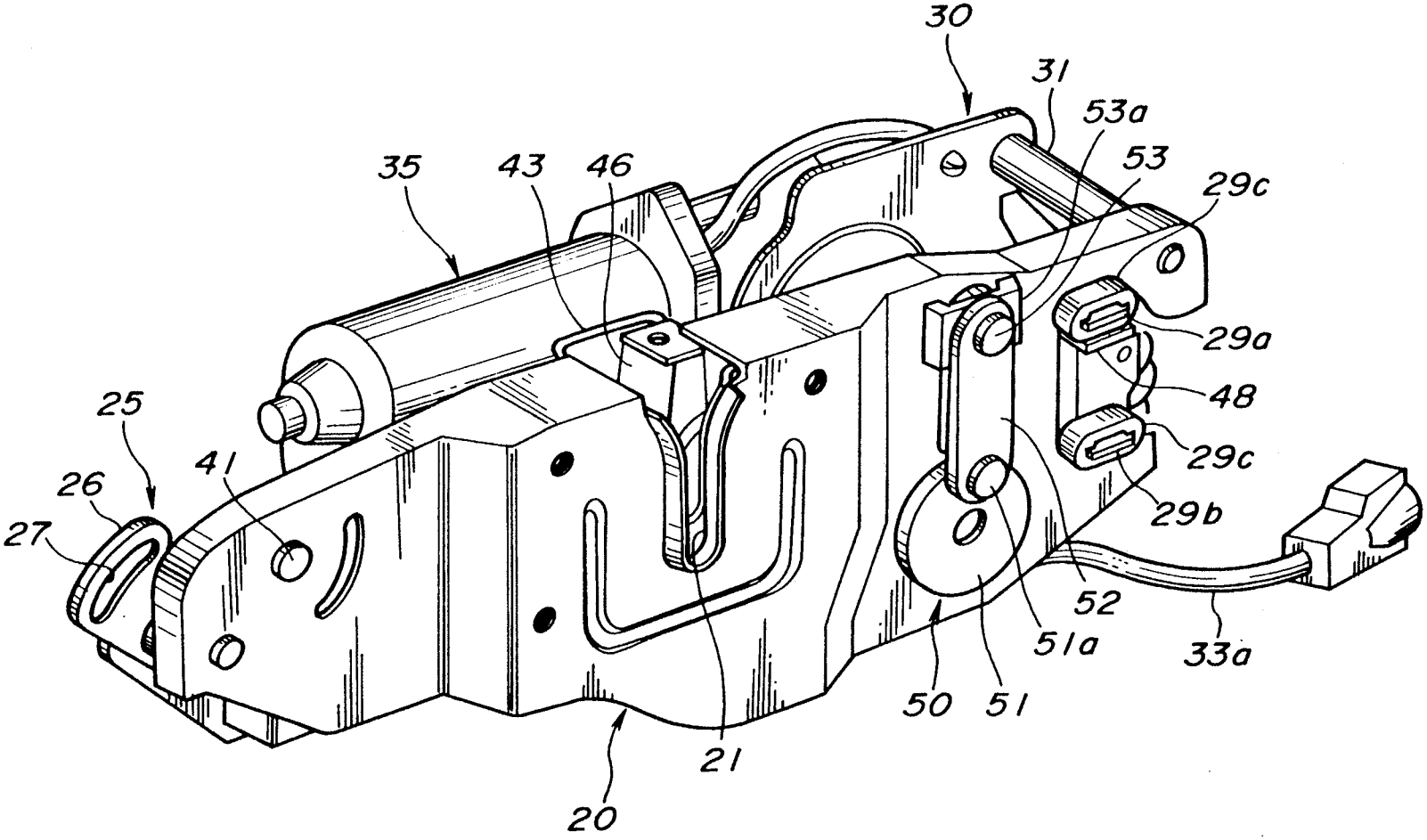
FIG. 5 is a perspective front view of the latch device of the invention.

As is best shown in FIG. 5 (which is a front view of the latch proper 100), the pull mechanism 50 comprises an annular input member 51 and an output link 52. The output link 52 has one end pivotally connected through a pin member 51*a* to a peripheral portion of the annular input member 51. The output link 52 has the other end equipped with an output pin 53 which is movably engaged with a vertically extending guide slot 23 (see FIGS. 1 and 6) formed in the base plate 20.

The guide slot 23 is formed about its peripheral portion with a flange 23*a* which serves as a guide member for the output pin 53 as will become apparent hereinafter.

Rotatably carried by the output pin 53 is a slide member 53*a* which is slidably engaged with the flange 23*a* of the guide slot 23 so that the slide member 53*a* can slide vertically along the guide slot 23. As is seen from FIG. 1, the output pin 53 has an inward end secured to one side portion of the latch supporting plate 40.

As is seen from FIGS. 1, 4, 5 and 7, a plurality of struts 31 extend between the base plate 20 and the motor supporting plate 30 for defining therebetween the parts-containing space 30*a*. The connection of these struts 31 to the base plate 20 and the motor supporting plate 30 is made by means of a caulking technique.

Figure 7:
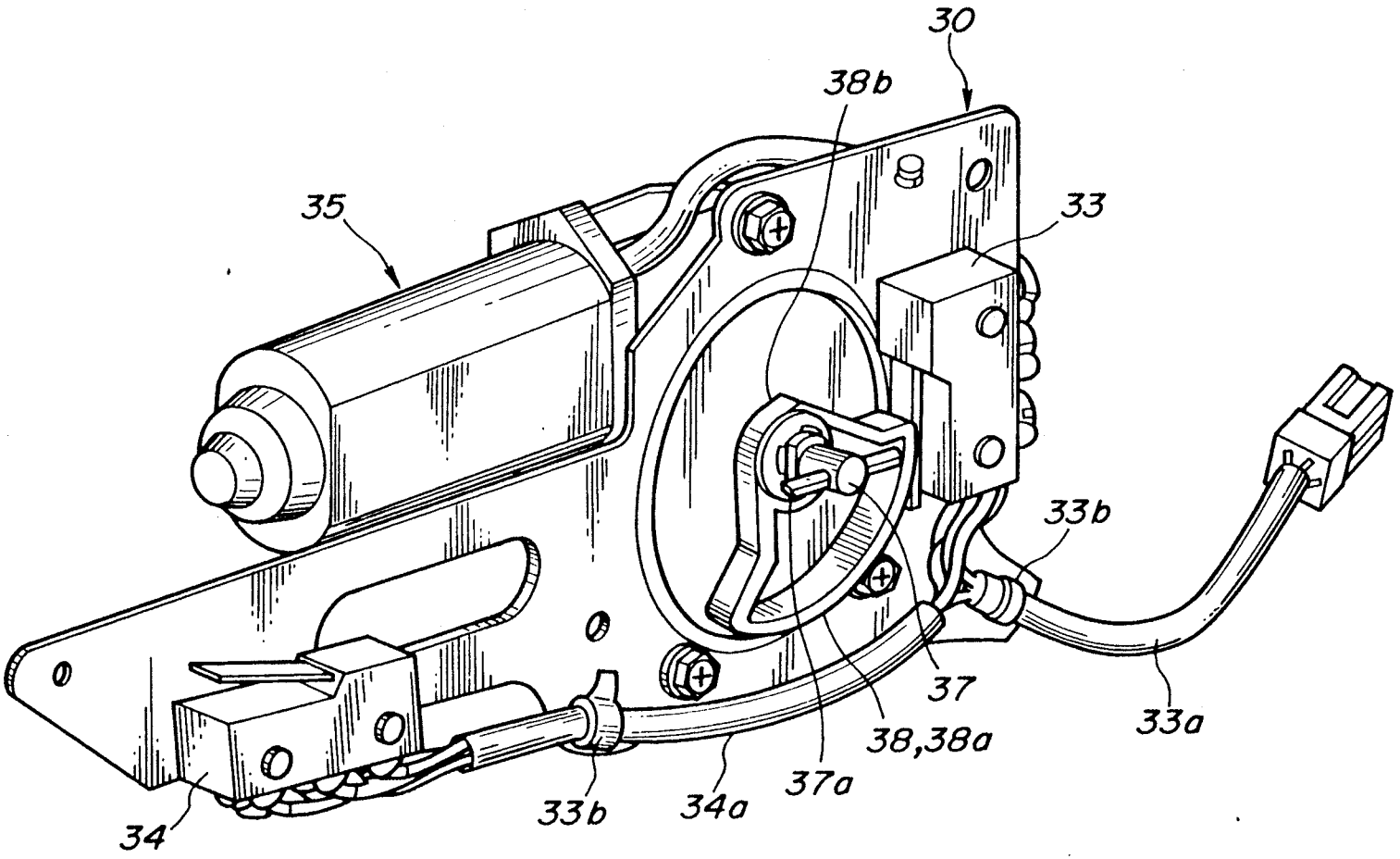
FIG. 7 is a perspective view of a motor supporting plate employed in the latch device of the invention.

As is seen from FIGS. 1 and 7, the motor supporting plate 30 is equipped at its back surface with an electric motor 35. The motor 35 is arranged to lie with its output shaft 35*a* (see FIG. 1) extending laterally. A speed reduction mechanism 36 is integrally connected to the motor 35. An output shaft 37 of the speed reduction mechanism 36 extends toward the motor supporting plate 30. The output shaft 37 has a pin 37*a* connected thereto.

As is seen from FIG. 1, the motor supporting plate 30 is formed at one side portion with an enlarged circular opening 32 through which the output shaft 37 extends into the parts-containing space 30*a*. A disc member 38 is secured to a base part of the output shaft 37 to rotate therewith and an input shaft 57 is connected through a lock releasing member 39 to the leading end of the output shaft 37. The input shaft 57 is coaxially connected to the input link 51 to rotate therewith. The disc member 38 is formed with larger and smaller diameter arcuate portions 38*a* and 38*b* which are concentric with the output shaft 37.

The lock releasing member 39 comprises an arcuate portion 39*a* which is concentric with the output shaft 37 and a connecting flange portion 39*b* which is held by the pin 37*a* to achieve an integral rotation of the input shaft 57 with the output shaft 37.

As is best seen from FIG. 7, the motor supporting plate 30 is equipped with a limit switch 33 which can detect the rotation of the disc member 38 driven by the electric motor 35. A wire cable 33*a* extends from the limit switch 33 and another wire cable 34*a* extends from the above-mentioned limit switch 34. These wire cables 33*a* and 34*a* are tightly connected to the motor supporting plate 30 by means of clips 33*b*.

Figure 8:
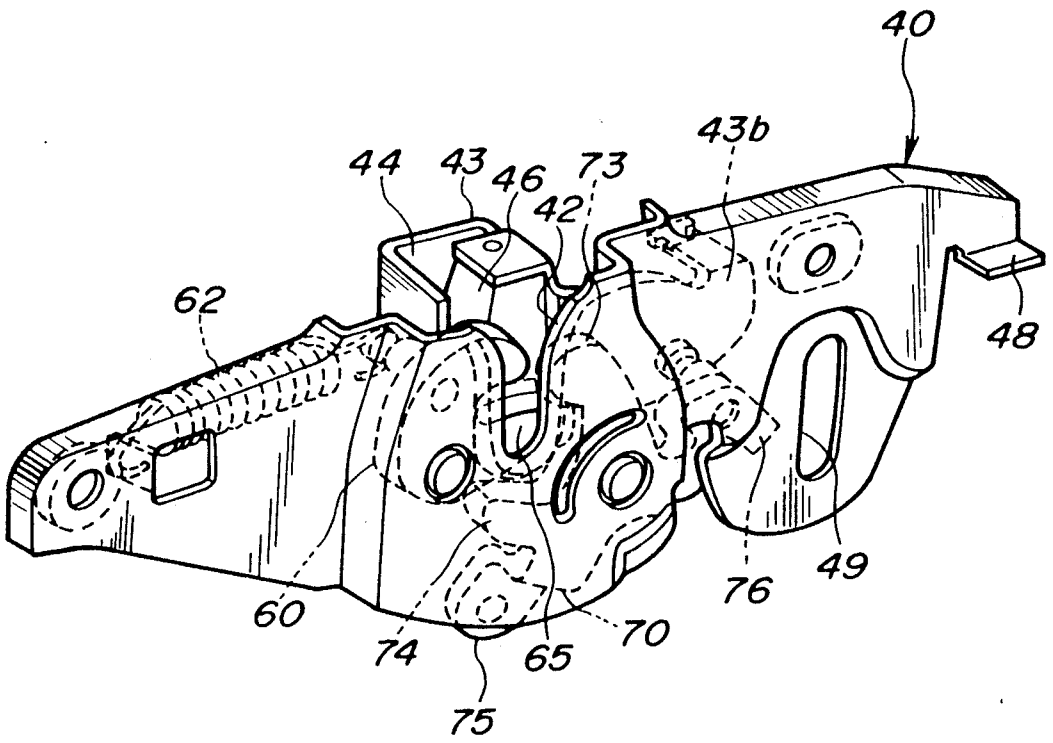
FIG. 8 is a perspective view of a latch supporting plate employed in the latch device of the invention.

As is seen from FIGS. 1 and 8, the latch supporting plate 40 is connected to the base plate 20 in a manner to pivot between upper and lower positions. For this pivoting, one end of the latch supporting plate 40 is connected to the side portion of the base plate 20 through a pivot shaft 41.

The other end of the latch supporting plate 40 is formed with a projection 48. The projection is brought into contact with upper and lower stopper flanges 29*a* and 29*b* of the base plate 20 when the latch supporting plate 40 assumes the upper and lower positions respectively. As is seen from FIG. 5, each stopper flange 29*a* or 29*b* is equipped with a shock damper 29*c* to damp the shock applied to thereto by the projection 48.

As is seen from FIG. 1, the latch supporting plate 40 is formed at its laterally middle portion with a striker guide slot 42 which is in alignment with the above-mentioned striker guide slot 21 of the base plate 20. As is best seen from FIG. 8, a damper holding bracket 43 is mounted to the back surface of the latch supporting plate 40 in a manner to cover the guide slot 42.

The bracket 43 is formed with a container 44 within which fixed and movable dampers 45 and 46 are installed. That is, as is understood from FIG. 1, the fixed damper 45 is directly connected to a bottom portion of the container 44, while, the movable damper 46 is connected to the bottom portion through a spring 47. Thus, when the movable damper 46 is applied with no stress, the same is somewhat raised as compared with the fixed damper 45. While, when the movable damper 46 is stressed downward, the same is moved down against the force of the spring 47 to its lower position. At this lower position, the fixed and movable dampers 45 and 46 are mated with each other to constitute an integral damper unit. The bracket 43 is formed at its laterally opposed sides with respective flanges 43*a* and 43*b* which extend in opposite directions.

The latch supporting plate 40 is formed at the other side portion with a vertically extending slot 49 through which the input shaft 57 passes.

A latch plate 60 is pivotally arranged between the flange 43*a* and the latch supporting plate 40. For this pivotal arrangement of the latch plate 60, a pivot shaft 61 is used which passes through the flange 43*a*, the latch plate 60 and the latch supporting plate 40 in this order. That is, the latch plate 60 pivots about the shaft 61 between a latch position wherein the latch plate 60 engages with the striker 12 and an unlatch position wherein the latch plate 60 disengages from the striker 12.

As will be seen from FIG. 8, near the latch plate 60, there is disposed a locking plate 70 which is pivotally connected through a pivot shaft 71 to the latch supporting plate 40. That is, the locking plate 70 pivots between a locking position wherein the latch plate 60 is locked at the latch position and an unlocking position wherein the latch plate 60 is forced to assume the unlatch position.

As is seen from FIGS. 1 and 4, the latch plate 60 is biased in a counterclockwise direction in FIG. 1 by a spring 62 which extends between the latch plate 60 and a raised part of the latch supporting plate 40. That is, the latch plate 60 is biased toward the unlatched position.

The locking plate 70 is biased in a clockwise direction in FIG. 1 by another spring 72 which extends between the locking plate 70 and another raised part of the latch supporting plate 40. That is, the locking plate 70 is biased toward the locking position. The locking plate 70 has both a locking pawl 73 which is used for locking the latch plate 60 at the latch position and a kicking projection 74 which is used for kicking the latch plate 60 upward. The locking plate 70 has a lower end 75 to which the other end of the afore-mentioned connecting rod 29 is pivotally connected.

The locking plate 70 further has another projection 76 with which the afore-mentioned lock releasing member 39 is engageable. As will become apparent hereinafter, when the lock releasing member 39 pushes the projection 76, the locking plate 70 is pivoted to the unlocking position.

As will be seen from FIG. 2, upon assembly to the vehicle body, the latch proper 100 is so oriented that the electric motor 35 lies with its output shaft 35*a* extending laterally. Such arrangement is advantageous in reducing the height of the entire construction of the latch proper 100, and thus, the latch proper 100 can be mounted in a limited space of the rear end of the vehicle body.

In the following, operation of the power operated latch device of the invention will be described.

For ease of understanding, the description will be commenced with respect to an open condition of the back door 10 as shown in FIG. 2.

Under this condition, the latch proper 100 assumes the condition as shown in FIGS. 4 and 9. That is, as is well shown in FIG. 4, the latch plate 60 assumes the unlatch position and the locking plate 70 assumes the unlocking position engaging with a chin part 65 of the latch plate 60. Furthermore, the output pin 53 of the pull-mechanism 50 is at its uppermost position causing the latch supporting plate 40 to assume its upper position. Furthermore, the larger diameter arcuate portion 38*a* of the disc member 38 pushes a probe pin of the limit switch 33. However, the inward projection 26*a* of the locking-unlocking mechanism 25 does not push a probe pin of the other limit switch 34.

Figure 10:
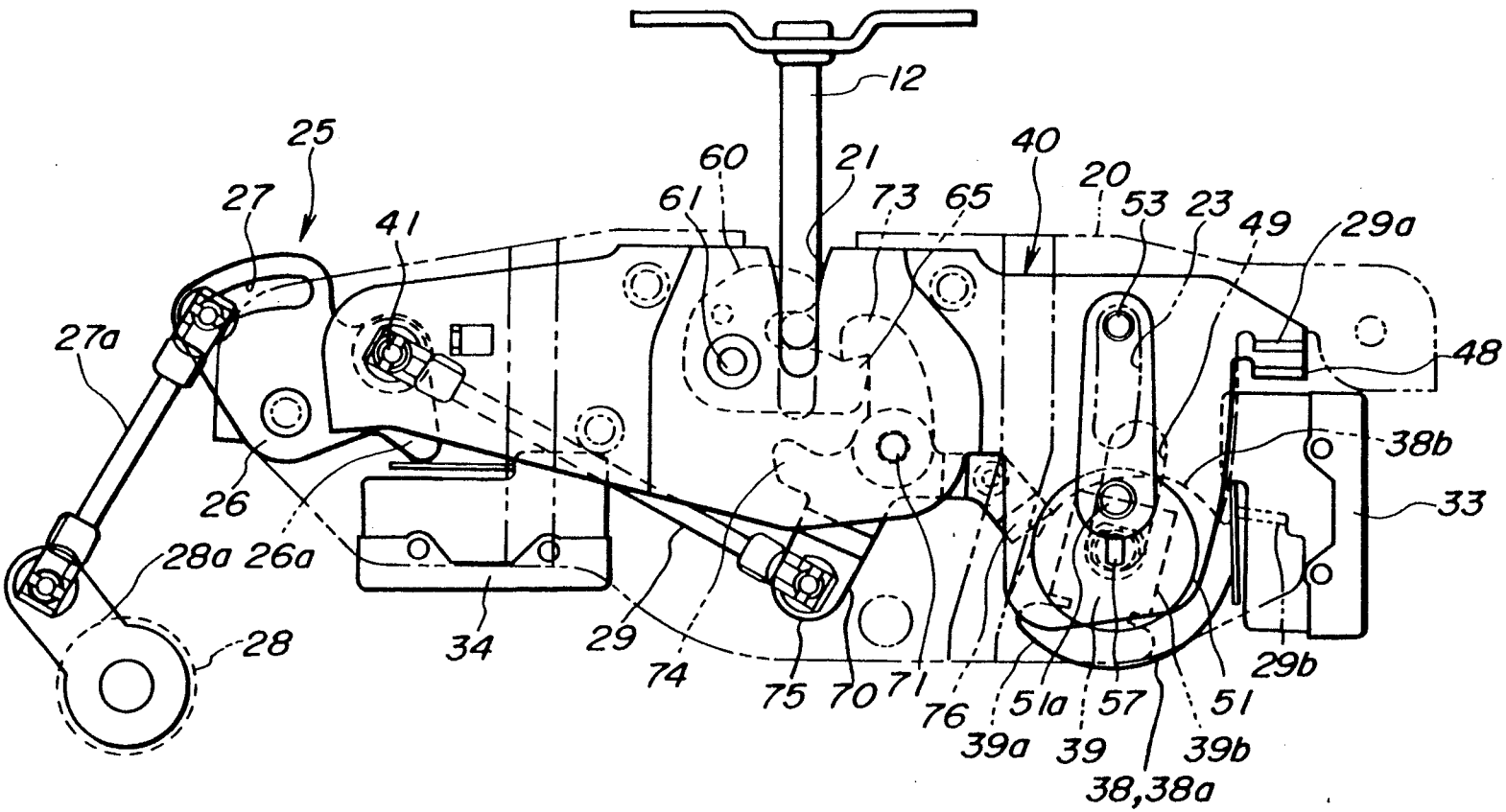

When, as is seen from FIG. 10, the back door 10 is pivoted down and comes to a position causing the striker 12 to be inserted into the striker guide slot 21, the striker 12 pushes down the chin part 65 of the latch plate 60 against the force of the spring 62 (see FIG. 4). With this, the latch plate 60 is brought into the latch position latching the striker 12, and at the same time, the chin part 65 of the latch plate 60 is brought into engagement with the locking pawl 73 of the locking plate 70. Thus, the latch plate 60 is locked at the latch position, as shown. Due to a pivotal movement of the locking plate 70 thus caused, the inward projection 26*a* of the locking-unlocking mechanism 25 pushes the probe pin of the limit switch 34 causing the ON condition of the switch 34. Thus, the locking position of the locking plate 70 is detected.

Figure 11:
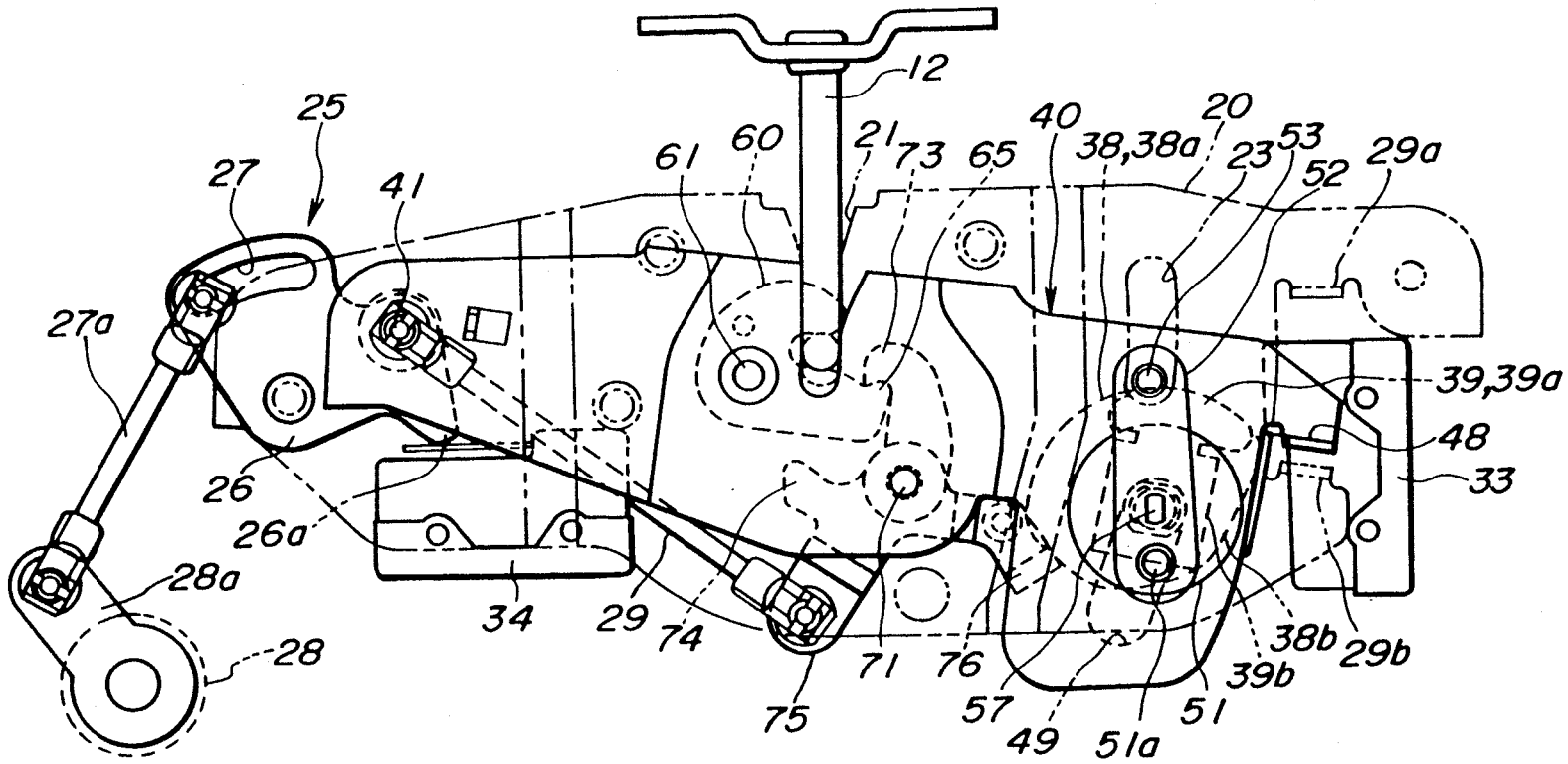

Upon the limit switch 34 taking the ON condition, the electric motor 35 becomes energized rotating the annular input member 51 in a counterclockwise direction in FIG. 11 through the speed reduction mechanism 36, the output shaft 37, the lock releasing member 39 and the input shaft 57. Due to the counterclockwise rotation of the annular input member 51, the output pin 53 of the pull-mechanism 50 is moved down along the guide slot 23 of the base plate 20. Thus, the latch supporting plate 40 is pivoted down about the pivot shaft 41.

When the annular input member 51 is further rotated in the counterclockwise direction, the output pin 53 finally comes to its lowermost position causing the latch supporting plate 40 to assume the lower position wherein the projection 48 of the plate 40 abuts against the lower stopper flange 29*b* of the base plate 20. Thus, the striker 12 thus restrained by the locked latch plate 60 is moved down together with the latch supporting plate 40, and thus, the back door 10 is brought to its fully closed latched position. When the output pin 53 comes to the lowermost position, the larger diameter arcuate portion 38*a* of the disc member 38 becomes disengaged from the probe pin of the limit switch 33 causing an OFF condition of the motor 35. That is, under this condition, the smaller diameter arcuate portion 38*b* faces the probe pin of the limit switch 33 without pushing the same.

During the pivoting movement of the latch supporting plate 40 about the pivot shaft 41, the connecting rod 29 is pivoted about its one end which is concentric with the pivot shaft 41, and thus, the bell-crank member 26 is not moved, thereby keeping the ON condition of the limit switch 34. Although the lock releasing member 39 is forced to rotate together with the annular input member 51, engagement of the member 39 with the projection 76 of the locking plate 70 does not occur, and thus, the locking plate 70 is kept in the locking position.

Figure 12:
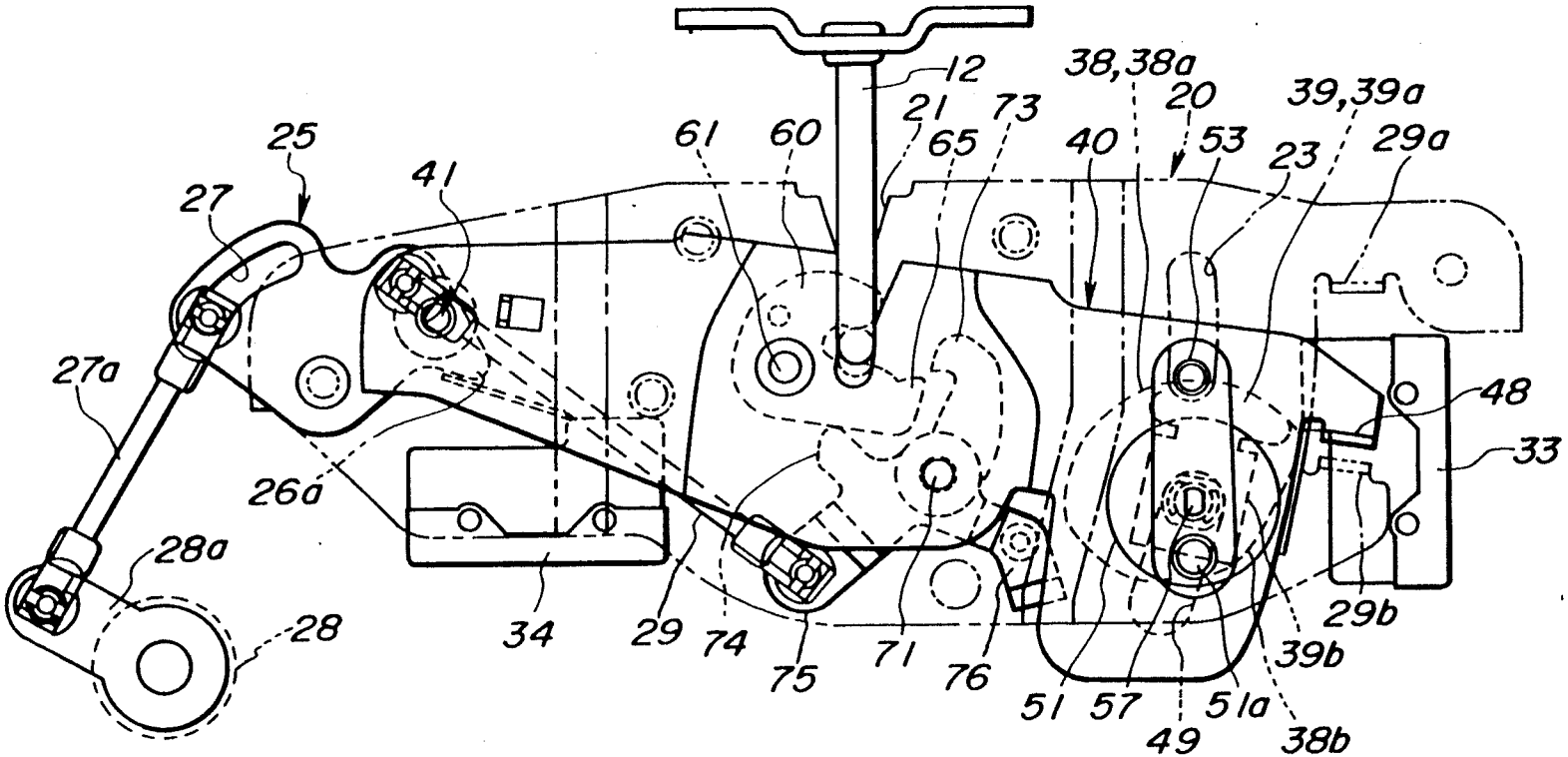

When, with the latch proper 100 assuming the condition of FIG. 11, the key cylinder 28 is turned in a counterclockwise direction by a key from outside of the vehicle body, the connecting rod 27*a* is moved toward the key cylinder 28 pivoting the bell-crank member 26 in a counterclockwise direction as shown in FIG. 12. Thus, the connecting rod 29 pivotally connected to the bell-crank member 26 is moved toward the bell-crank member 26 pulling the lower end 75 of the locking plate 70. Thus, the locking plate 70 is pivoted in a clockwise direction about the pivot shaft 71 to take the unlocking position thereby releasing the latch plate 60. Thus, the locked condition of the latch plate 60 is cancelled. That is, the latch plate 60 can be returned to the unlatch position when the striker 12 is raised.

Figure 14:
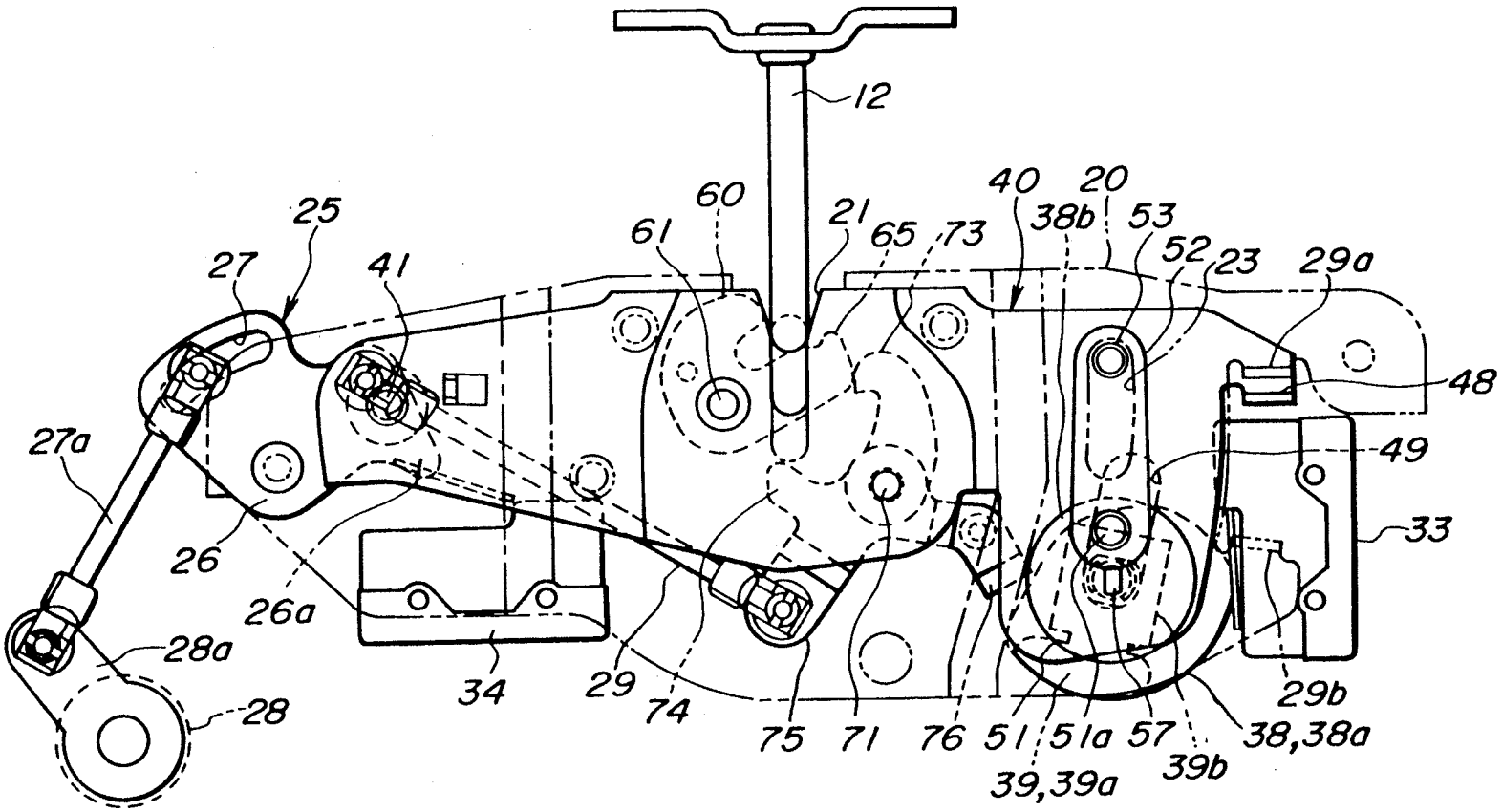

The counterclockwise movement of the bell-crank member 26 disengages the projection 26*a* from the probe pin of the limit switch 34 causing the limit switch 34 to assume the OFF condition. With this, the electric motor 35 is energized to rotate the annular input member 51 in a clockwise direction in FIG. 12 moving the output pin 53 upward along the guide slot 23 of the base plate 20. With this, the latch supporting plate 40 is pivoted upward about the pivot shaft 41 to the upper position as shown in FIG. 14. When the output pin 53 comes up to the uppermost position, the larger diameter arcuate portion 38*a* of the disc member 38 comes to a position to push the probe pin of the limit switch 33 causing de-energization of the electric motor 35. Thus, the upper position of the latch supporting plate 40 is maintained. Under this condition, the striker 12 of the back door 12 is disengaged from the latch proper 100, and thus, the back door 10 can be opened when pushed upward.

Figure 13:
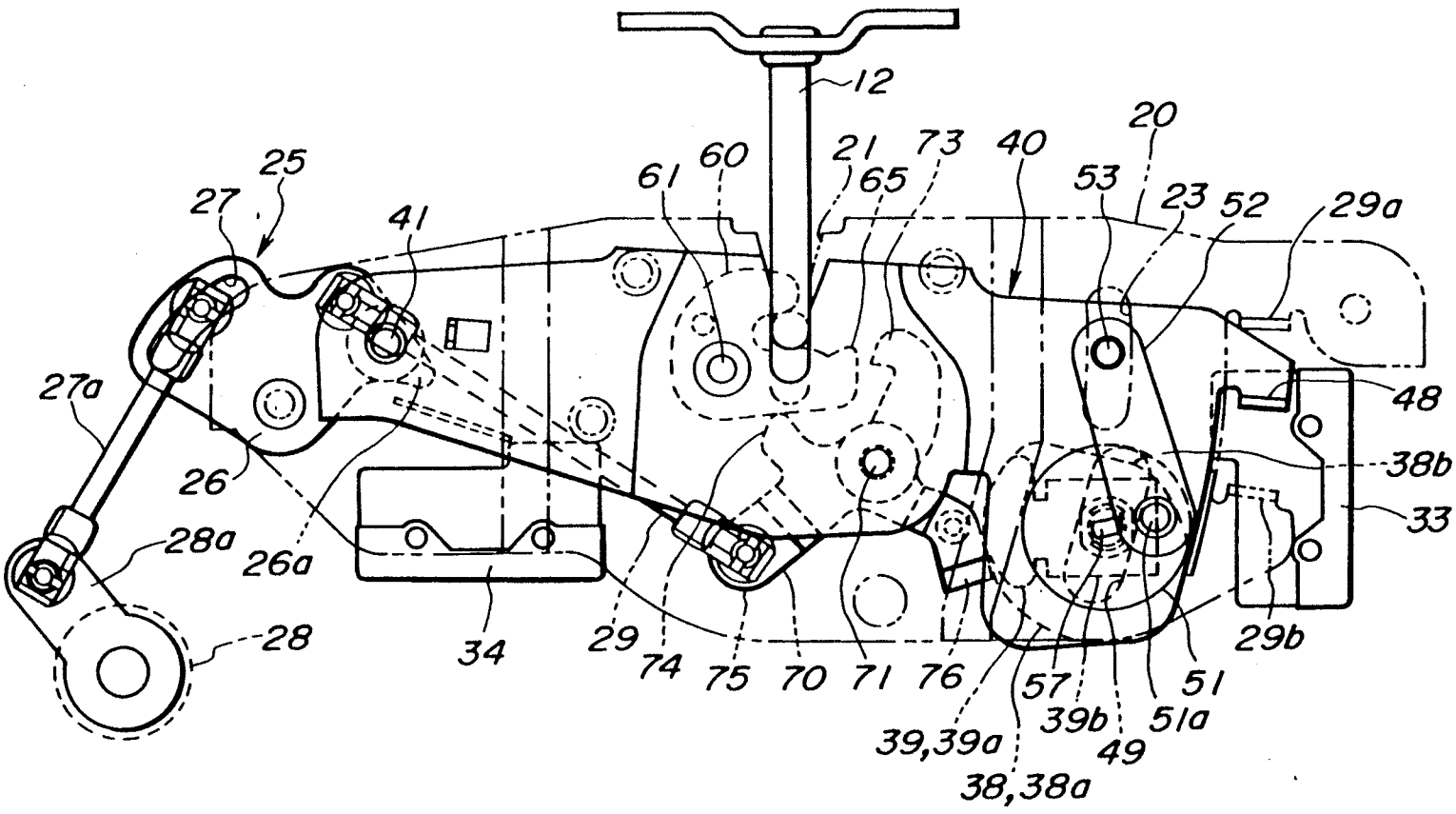

When, with the latch proper 100 assuming the condition of FIG. 11, a control button installed in the vehicle cabin is operated by a driver or the like, the electric motor 35 becomes energized to turn the output shaft 37 in a counterclockwise direction. With this, the lock releasing member 39 is rotated in the same direction causing the arcuate portion 39*a* thereof to push down the projection 76 of the locking plate 70. Thus, the locking plate 70 is turned in a clockwise direction about the pivot shaft 71 causing the locking pawl 73 to disengage from the chin part 65 of the latch plate 60 and causing the kicking projection 74 to kick up the chin part 65 of the latch plate 60. With this, the latch plate 60 is forced to pivot about the pivot shaft 61 in a counterclockwise direction, that is, toward the unlatch position, pushing up the striker 12, as is seen from FIG. 13. During this, due to rotation of the annular input member 51 in a counterclockwise direction, the output pin 53 and thus the latch supporting plate 40 is pivoted upward and finally comes to the upper position as is shown in FIG. 14. Furthermore, during this, the larger diameter arcuate portion 38*a* of the disc member 38 comes to a position to push the probe pin of the limit switch 33 causing the ON condition of the switch 33. Thus, the electric motor 35 becomes deenergized stopping the latch supporting plate 40 at the upper position. Under this condition, the back door 10 can be opened when pushed upward.

In the following, advantages of the present invention will be described.

First, because the electric motor 35 is arranged to lie parallel with respect to the base plate 20, the latch proper 100 of the invention can be mounted in a limited space of the rear end portion of the vehicle body.

Second, since the two limit switches 34 and 33 are mounted to the base plate 20 which is secured to the vehicle body, there is no need of providing any play in the wire cables 33*a* and 34*a*. That is, these wire cables 33*a* and 34*a* can be tightly secured to the base plate 20. If such wire cables are mounted to a movable member, such as, the latch supporting plate 40, it becomes necessary to provide some play to them. In this case, however, there arises a danger of damaging the cables during loading and unloading of luggage into and from the vehicle cabin through the back door opening 16.

Third, since the base plate 20, the motor supporting plate 30, the latch supporting plate 40 and their associated parts mounted thereto each constitute a so-called "module", the assembly of the latch device is facilitated. Furthermore, inspection of parts can be made for each module.

What is claimed is:

1. A power operated latch device for use with mutually movable first and second structures, said latch device comprising:

a striker secured to said second structure;

a latch proper mounted to said first structure, said latch proper including:

a base structure having a striker guide slot into which said striker is inserted when said first and second structures come close to each other;

a pivotal structure pivotally connected to said base structure and pivotal between upper and lower positions relative to said base structure;

a latch plate pivotally carried by said pivotal structure and engageable with said striker;

an electric motor securely connected to said base structure, said electric motor being arranged to lie parallel with respect to said base structure;

first means for forcibly pivoting said pivotal structure between said upper and lower positions with the aid of said electric motor; and second means for disengaging said striker from said latch plate with the aid of said electric motor.

2. A power operated latch device as claimed in claim 1, in which said striker guide slot of said base structure extends in a first direction and an output shaft of said electric motor extends in a second direction which is perpendicular to said first direction.

3. A power operated latch device as claimed in claim 2, further comprising first and second sensor switches which sense movements of said latch plate and said pivotal structure for controlling the operation of said electric motor.

4. A power operated latch device as claimed in claim 3, in which said latch proper further comprises:

a locking-unlocking mechanism which can selectively lock and unlock said latch plate when said latch plate latches said striker; and a key cylinder linked to said locking-unlocking mechanism to actuate the same in response to movement of a key installed in said key cylinder.

5. A power operated latch device for use with mutually movable first and second structures, said latch device comprising:

a striker secured to said second structure;

a latch proper mounted to said first structure, said latch proper including:

a base plate secured to said first structure and having a striker guide slot into which said striker is inserted when said first and second structures come close to each other;

a motor supporting plate securely connected to said base plate in a manner to define therebetween a space, said motor supporting plate having an electric motor mounted thereto, said motor being arranged to lie with respect to said base plate in such a manner that an output shaft of said electric motor extends in a direction perpendicular to a direction in which said striker guide slot extends;

a latch supporting plate installed in said space and pivotal between upper and lower positions, said latch supporting plate carrying a pivotal latch plate which is engageable with said striker;

first means for forcibly pivoting said latch supporting plate between said upper and lower positions with the aid of said electric motor; and second means for forcibly driving said latch plate in a direction to disengage said striker from said latch plate with the aid of said electric motor.

6. A power operated latch device as claimed in claim 5, in which said first means comprises:

an annular member rotatably connected to said base plate;

rotation transmitting means for transmitting the rotation of said output shaft of said electric motor to said annular member;

a link having one end pivotally connected to a peripheral portion of said annular member;

an output pin secured to said latch supporting plate, said output pin being pivotally connected to the other end of said link; and guide means for guiding the movement of said output pin relative to said base plate.

7. A power operated latch device as claimed in claim 6, in which said rotation transmitting means comprises:

a speed reduction mechanism operatively connected to said output shaft of said electric motor; and an input shaft through which an output shaft of said speed reduction mechanism is connected to said annular member.

8. A power operated latch device as claimed in claim 7, in which said output shaft of said speed reduction mechanism passes through respective openings formed in said motor supporting plate and said latch supporting plate.

9. A power operated latch device as claimed in claim 6, in which said guide means comprises:

means for defining in said base plate a vertically extending slot in and along which said output pin slides, said slot being formed about its periphery with a flange; and a slide member slidably engaged with said flange, said slide member having an opening through which said output pin loosely passes.

10. A power operated latch device as claimed in claim 6, in which said second means comprises:

a locking plate pivotally connected to said latch supporting plate, said locking plate pivoting between a locking position wherein said latch plate is locked at the latch position and an unlocking position wherein the latch plate is forced to assume the unlatch position; and a lock releasing member powered by said electric motor, said lock releasing member moving said locking plate from said locking position to said unlocking position when rotated in a given direction by said electric motor.

11. A power operated latch device as claimed in claim 10, in which said locking plate is formed with a kicking projection which, when pivoted from the locking position toward the unlocking position, kicks up said latch plate to cause the same to assume the unlatch position.

12. A power operated latch device as claimed in claim 10, further comprising first and second sensor structures which sense movements of said latch plate and said latch supporting plate for controlling the operation of said electric motor.

13. A power operated latch device as claimed in claim 12, in which said first sensor structure comprises a disc member driven by said electric motor, said disc member being formed with larger and smaller diameter arcuate portions, and a limit switch having a probe pin which is actuated by said larger diameter arcuate portion, and in which said second sensor structure comprises a bell-crank member pivotally connected to said base plate and having a projection, a rod for transmitting movement of said locking plate to said bell-crank member, and a limit switch having a probe pin which is actuated by said projection of said bell-crank member.

14. A power operated latch device as claimed in claim 13, in which said latch proper further comprises a key cylinder mechanism which includes:

a key cylinder mounted to said first structure, said key cylinder having a link member which rotates together with said key cylinder; and a connecting rod connecting said link member with said bell-crank member.

15. A power operated latch device as claimed in claim 14, in which said bell-crank member is formed with an elongate slot with which an end of said connecting rod is slidably engaged.

* * * * *